US011673104B2

(12) United States Patent
Sabey et al.

(10) Patent No.: US 11,673,104 B2
(45) Date of Patent: Jun. 13, 2023

(54) MULTI-FLUID INJECTION MIXER AND RELATED METHODS

(71) Applicant: PRODUCED WATER ABSORBENTS INC., Houston, TX (US)

(72) Inventors: John Sabey, Houston, TX (US); William Jagers, Houston, TX (US); Yuecun Lou, Houston, TX (US); Tommie Jackson, III, Houston, TX (US)

(73) Assignee: PRODUCED WATER ABSORBENTS INC., Houston, TX (US)

( * ) Notice: Subject to any disclaimer, the term of this patent is extended or adjusted under 35 U.S.C. 154(b) by 568 days.

(21) Appl. No.: 16/706,356

(22) Filed: Dec. 6, 2019

(65) Prior Publication Data

US 2020/0179883 A1 Jun. 11, 2020

Related U.S. Application Data

(60) Provisional application No. 62/776,856, filed on Dec. 7, 2018.

(51) Int. Cl.
*F17D 3/12* (2006.01)
*B01F 25/312* (2022.01)
(Continued)

(52) U.S. Cl.
CPC ..... *B01F 25/31241* (2022.01); *B01F 23/21* (2022.01); *F17D 3/12* (2013.01);
(Continued)

(58) Field of Classification Search
CPC ..... B01F 25/31241; B01F 25/31242; B01F 25/31252; B01F 25/31423; B01F 23/21; F17D 3/12
See application file for complete search history.

(56) References Cited

U.S. PATENT DOCUMENTS 1,233,557 A * 7/1917 Curtis ..... F02M 9/127 137/895
2,361,150 A * 10/1944 Petroe ..... B01F 25/3131 366/175.2
(Continued)

FOREIGN PATENT DOCUMENTS

CN 206027482 3/2017
DE 2508665 9/1976
(Continued)

OTHER PUBLICATIONS

International Search Report and Written Opinion issued in Corresponding PCT Application No. PCT/US2019/065030, dated Jun. 24, 2020.
(Continued)

*Primary Examiner* — Matthew W Jellett
*Assistant Examiner* — Christopher D Ballman
(74) *Attorney, Agent, or Firm* — Norton Rose Fulbright US LLP

(57) ABSTRACT

The present disclosure includes mixing apparatuses comprising a pipe having an internal channel having a convergent frustoconical portion, and a divergent portion. The divergent portion may comprise a divergent frustoconical portion and an annular, concave curved portion. A plurality of injection ports may be spaced circumferentially in the convergent frustoconical portion and communicate a liquid into internal channel. The plurality of injection ports may define an opening in the internal channel having a first dimension in a circumferential direction that is larger than a second dimension in a longitudinal direction. The injection mixer may be configured to mix a first fluid flowing through the pipe with the second fluid to form a fully homogenous, dispersed fluid mixture.

20 Claims, 10 Drawing Sheets

(51) Int. Cl.
*B01F 23/21* (2022.01)
*B01F 25/314* (2022.01)

(52) U.S. Cl.
CPC ... *B01F 25/31242* (2022.01); *B01F 25/31252* (2022.01); *B01F 25/31423* (2022.01)

(56) References Cited

U.S. PATENT DOCUMENTS 2,563,002 A * 8/1951 Bissell ..... B01F 25/3142 137/888
3,524,630 A 8/1970 Marion
3,799,195 A * 3/1974 Hermans ..... F23D 14/60 137/553
4,123,800 A * 10/1978 Mazzei ..... B01F 25/4336 366/181.5
4,210,166 A * 7/1980 Munie ..... B01F 25/4335 137/271
4,416,610 A * 11/1983 Gallagher, Jr. ..... B01F 25/312 137/888
4,664,147 A 5/1987 Maddock
4,673,006 A * 6/1987 Speck ..... B08B 9/0933 137/892
4,812,049 A 3/1989 McCall
4,931,225 A * 6/1990 Cheng ..... B01J 10/002 417/151
4,989,988 A 2/1991 Hutter et al.
4,993,495 A * 2/1991 Burchert ..... B01F 25/31 261/DIG. 26
5,145,256 A 9/1992 Wiemers
5,547,540 A 8/1996 Ruscheweyh
5,590,961 A 1/1997 Rasmussen
5,597,236 A 1/1997 Fasano
5,693,226 A * 12/1997 Kool ..... C02F 3/1294 137/888
5,796,798 A * 8/1998 Aujollet ..... G21C 9/004 165/110
5,839,828 A 11/1998 Glanville
5,863,128 A * 1/1999 Mazzei ..... B01F 25/31242 137/896
5,893,641 A * 4/1999 Garcia ..... B01F 25/312 137/888
5,935,490 A * 8/1999 Archbold ..... B01F 25/3142 261/76
5,971,604 A 10/1999 Linga et al.
6,132,079 A 10/2000 King
6,341,888 B1 * 1/2002 Ekholm ..... B01F 25/31425 366/167.1
6,508,386 B2 1/2003 Magri
6,572,258 B1 6/2003 Holland
6,623,154 B1 * 9/2003 Garcia ..... B01F 25/31423 137/888
6,767,007 B2 * 7/2004 Luman ..... B01F 23/232 261/76
6,986,832 B2 * 1/2006 Lamminen ..... B01F 25/431 162/336
7,357,565 B2 * 4/2008 Gopalan ..... B01F 25/31241 366/163.2
7,416,326 B2 * 8/2008 Sakata ..... C02F 1/50 366/337
8,845,178 B2 * 9/2014 Hanada ..... B01F 23/451 137/888
9,227,161 B2 * 1/2016 Bormes ..... B01F 23/29
9,295,953 B2 3/2016 Linga et al.
10,625,221 B2 * 4/2020 Schneider ..... B01F 35/561
10,644,337 B2 * 5/2020 Finnerty ..... B01J 19/006
2002/0096792 A1 * 7/2002 Valela ..... B01F 23/232 261/4
2003/0080037 A1 * 5/2003 Mazzei ..... B01F 23/29 210/188
2003/0155436 A1 * 8/2003 Nilsen ..... B01D 53/1462 239/427
2009/0174087 A1 7/2009 Bauer
2015/0176542 A1 * 6/2015 Balsdon ..... B01F 25/31243 137/888
2016/0030898 A1 2/2016 Devoy et al.

FOREIGN PATENT DOCUMENTS

DE 102006055655 5/2008
EP 0300964 1/1989
EP 0673885 9/1995
EP 2016994 1/2009
EP 2821130 1/2015
GB 1152194 5/1969
KR 20140002970 1/2014
WO WO 2001/007169 2/2001
WO WO 02/00334 1/2002

OTHER PUBLICATIONS

International Search Report and Written Opinion issued in PCT/NO2005/000352, dated Jan. 24, 2006.
Appeal against decision to refuse European Application No. 05792090.2, filed Feb. 6, 2017.
Decision of the Examining Division of the European Patent Office issued in European Application No. 05792090.2, dated Febmary 15, 2017.
Office Action issued in European Application No. 05792090.2, dated Jul. 25, 2017.
Response to Attend Oral Proceedings filed in European Application No. 05792090.2, dated Apr. 11, 2014.
Response to Office Action issued in European Application No. 05792090.2, dated Nov. 16, 2017.

* cited by examiner

MULTI-FLUID INJECTION MIXER AND RELATED METHODS

CROSS-REFERENCE TO RELATED APPLICATIONS

This application claims the benefit of priority to U.S. Provisional Patent Application Ser. No. 62/776,856, filed Dec. 7, 2018, hereby incorporated by reference in its entirety.

FIELD OF INVENTION

The present invention relates generally to fluid mixers and, more particularly but without limitation, to multi-fluid pipeline injection mixers. This invention also extends to methods for efficiently mixing two or more fluids, in particular, fluids of differing phases.

BACKGROUND

Fluid mixing finds applications in most industries. For fluids flowing in a pipeline, for example, fluid processing typically involves phase separation of the fluid contents and delivery of the separated contents at a specified quality, according to subsequent use. Fluid processing is common in industries, such as food production (e.g., production of emulsion), pharmaceuticals, chemicals, paper (e.g., refining and pulp treatment), melts, and other processes. While these processes generally involve batch production in a large vessel, the use of pipe flow mixing is an attractive alternative due to investment, operational costs, flexibility in production, safety, and product quality.

The mixing of fluids is essential to operations in the oil and gas sector, particularly as related to the processing of hydrocarbons, as described in more detail below. Fluids are typically introduced into the flow of a pipe upstream of processing equipment, such as upstream of a separator or compressor. During fluid mixing, the fluid is typically injected at a low rate compared to the process flow rate. Fluid injection can thus pose challenges, including achieving adequate dispersion and mixing of the injected fluid within the process flow.

For example, when processing hydrocarbons to distribute liquefied natural gas (LNG) at the end of a pipeline, natural gas liquids ("NGLs"), such as propane, butane, and/or other alkanes and hydrocarbons, can be injected into a pipeline carrying LNG feedstock after having been previously separated. This process reduces the number of heavier hydrocarbons, such as a hydrocarbon compound with 6 or more carbon atoms (C6+). The NGLs are introduced into the pipe upstream from a compression stage of the pipeline. The NGLs are mixed with the flowing LNG feedstock. This process allows the production of larger amounts of liquids after the compressor, which in turn can reduce heavier hydrocarbons (C6+) that are known to accumulate on compressor blades as crystals (aromatics) or liquids (C6+). However, the introduction of liquid prior to a compression stage can have adverse effects if any liquid remains in the feedstock stream. Therefore, it is important that any liquids introduced prior to a compressor, transform in a fully gaseous state and maintain a gaseous state throughout the compression process to avoid mechanical issues with liquid or solid formation.

Maintaining a purely gaseous state throughout compression poses a serious challenge. The known methods and apparatuses used to alleviate liquid build-up each have their own deficiencies. Injection quills are the most common device used in fluid injection mixers. Injection quills provide low effective distribution of the liquid into the process flow. To facilitate an acceptable injection rate for a system, a high number of quills are needed with complicated controls to vary injection amounts. In addition, quills only operate well under certain pressure and flow conditions, thereby limiting injection turndown and increasing the number of quills/atomizers required to meet injection ranges. This is problematic for pipelines with varying feedstock flow rates and injection requirements.

Static mixers are also employed to reduce fluid build-up. However, the use of static mixers may result in erratic fluid distribution from uneven shear forces acting on an injected fluid, and accumulation of liquids at nodes. Uneven shear forces can result in poor dispersion of fluids. Additionally, this process also requires large pressure drops which, consequently, causes expansion and cooling of the gas, leading to further liquid build-up in the pipe flow. The pressure drops can generate fluid droplet breakup and entrainment into the gas stream. Unfortunately, these high pressure drops eventually have to be reversed during the compression stage, therefore increasing the energy required for the production of LNG.

Heaters are often used in combination with static mixers to reduce cooling of the flow. The amount of heat required, either onto the feedstock line or onto the liquid injection line, to eliminate liquid build-up in the pipe flow can be impractical. Often times LNG feedstocks are so large that heating streams are either physically or economically impractical. Additionally, added heat does not necessarily guarantee total evaporation as inconsistent fluid droplet distribution, created from poor mixing, can result in large droplets that cannot evaporate quickly enough in the available length of pipe before compression.

Current fluid mixers do not allow for full evaporation of injected fluid in a short length of pipe. Known fluid mixers also permit liquid buildup in the pipeline after pressure drops. In addition, the fluid mixers do not allow for fully customizable parameters of fluid dispersion and evaporation based on the desired characteristics of the pipe flow. Some systems may necessitate full evaporation of added liquids while others may emphasis adsorption over evaporation percentage. Currently there is no known method for teaching how injection properties effect droplet breakup in the injection mixers.

SUMMARY

This disclosure includes various configurations of mixers and methods of mixing.

In some configurations, the present multi-fluid injection mixers (e.g., for injecting a liquid into a gas stream, a liquid into a liquid stream, or a gas into a liquid stream) comprise: a body having an interior surface that defines an internal channel, the internal channel comprising: a convergent frustoconical portion and a divergent portion. The convergent frustoconical portion can extend from an upstream end to a downstream end. The divergent portion can comprise: a divergent frustoconical portion extending from an upstream end to a downstream end; and an annular, concave curved portion extending from the downstream end of the convergent frustoconical portion to the upstream end of the divergent frustoconical portion; where the downstream end of the convergent frustoconical portion defines a first inside diameter of the internal channel and the upstream end of the divergent frustoconical portion defines a second inside diameter of the internal channel; and where the first inside diameter is smaller than the second inside diameter.

In some configurations of the present multi-fluid injection mixers, the body defines a plurality of injection ports spaced circumferentially in the convergent frustoconical portion. In some configurations, the plurality of injection ports each has a first dimension in a circumferential direction and a second dimension in a longitudinal direction of the internal channel, where the first dimension is larger than the second dimension. In some configurations, the body comprises: an outer pipe defining a channel; and an insert comprising the convergent frustoconical portion and the divergent portion, at least a portion of the insert is disposed within the channel of the outer pipe.

Some configurations of the present multi-fluid injection mixers further comprise: a shear edge defined by an acute angle in the body at the intersection of the downstream end of the convergent frustoconical portion and the annular concave curved portion. In some configurations, the divergent portion has a maximum transverse dimension at the divergent frustoconical portion and is configured to induce turbulent flow in a gas stream. In some configurations, the shear edge is configured to disperse the mixing fluid to form droplets that are subject to secondary breakup and mixing or evaporation as the droplets travel through the divergent frustoconical portion. In some configurations, the annular, concave curved portion is configured to receive a residual droplet of the mixing fluid that is not entrained by the gas stream at the shear edge. In some configurations, a curvature of the annular, concave curved portion is configured to induce back flow recirculation in the gas stream facilitate secondary breakup of the residual droplet complete evaporation of the mixing fluid.

Some configurations of the present multi-fluid injection mixers (e.g., for injecting a liquid into a gas stream, a liquid into a liquid stream, or a gas into a liquid stream) comprise: a body having an interior surface that defines an internal channel, the pipe comprising: a convergent frustoconical portion extending from an upstream end to a downstream end; and a divergent portion. The divergent portion can comprise: a divergent frustoconical portion extending from an upstream end to a downstream end. The body can define a plurality of injection ports spaced circumferentially in the convergent frustoconical portion, each of the injection ports extending through the interior surface of the body and having, at the interior surface: a first dimension in a circumferential direction; and a second dimension in a longitudinal direction of the internal channel; where the first dimension is larger than the second dimension.

In some configurations of the present multi-fluid injection mixers, the body comprises: an outer pipe defining a channel; and an insert comprising the convergent frustoconical portion and the divergent portion, at least a portion of the insert is disposed within the channel of the outer pipe. In some configurations, divergent portion further comprises: an annular, concave curved portion disposed between the convergent frustoconical portion and the divergent frustoconical portion. Some configurations further comprise: a shear edge defined by an acute angle in the body at the intersection of the downstream end of the convergent frustoconical portion and the annular concave curved portion In some configurations, the longitudinal distance between the plurality of injection ports and the shear edge is less than 5 mm. In some configurations, the first dimension is between 2-25 mm. In some configurations, a curvature of the annular, concave curved portion is configured to induce back flow recirculation in the gas stream to re-entrain a residual fraction of the mixing fluid that is not entrained by the gas stream at the shear edge.

Some configurations of the present multi-fluid injection mixers further comprise: a first pipe segment coupled to an upstream end of the body; a second pipe segment coupled to a downstream end of the body; and an injection assembly in fluid communication with the plurality of injection ports.

Some implementations of the present methods (e.g., for mixing fluids) comprise: receiving a first fluid in a configuration of the present multi-fluid injection mixers; communicating a first fluid through the convergent frustoconical portion; injecting a second fluid into the convergent frustoconical portion, accelerating the first fluid, where the first fluid has a higher velocity than the second fluid such that the second fluid is broken up into droplets; dispersing the droplets of the second fluid in the divergent portion; and mixing the first fluid and the second fluid.

Some implementations of the present methods further comprise: inducing backflow re-circulation of the first fluid; and dispersing any residual droplets of the second fluid in the annular, concave curved portion.

In some implementations of the present methods, injecting a second fluid comprises: communicating the second fluid to a plurality of injection ports disposed around the convergent frustoconical portion; introducing the second fluid into the inner channel; dispersing the second fluid in the inner channel such that the second fluid forms a film on a surface of the convergent frustoconical portion.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the term "substantially" may be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments. These and other features, aspects, and advantages of the present invention will become better understood with reference to the following description and claims

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. Each of the figures is drawn to scale, unless otherwise noted, meaning the sizes of the elements depicted therein are accurate relative to each other for at least the embodiment in the figures.

DETAILED DESCRIPTION OF ILLUSTRATIVE EMBODIMENTS

Figure 1:
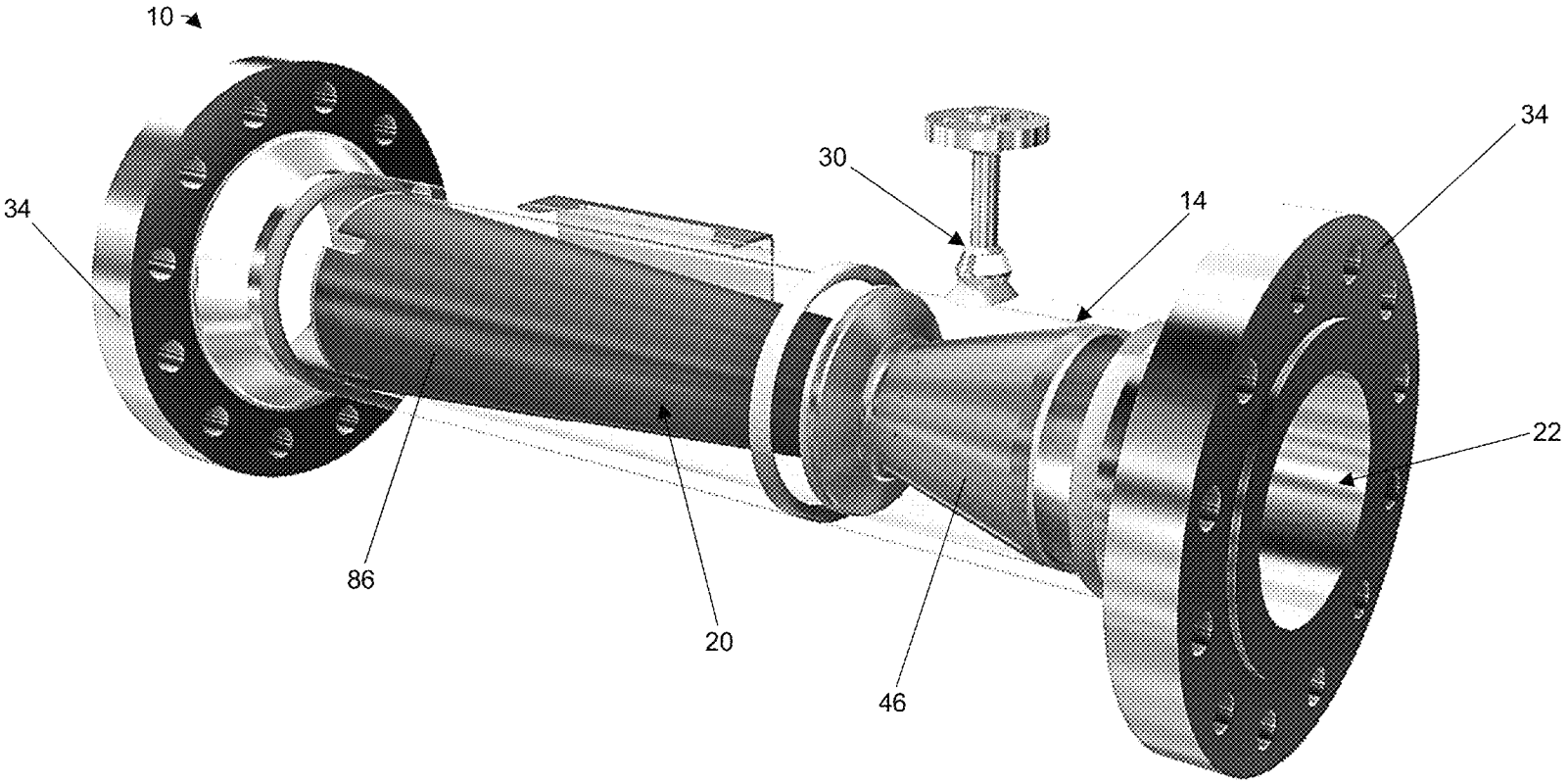
FIG. 1 is a perspective view of a first side of an embodiment of the present injection mixer.
Figure 2:
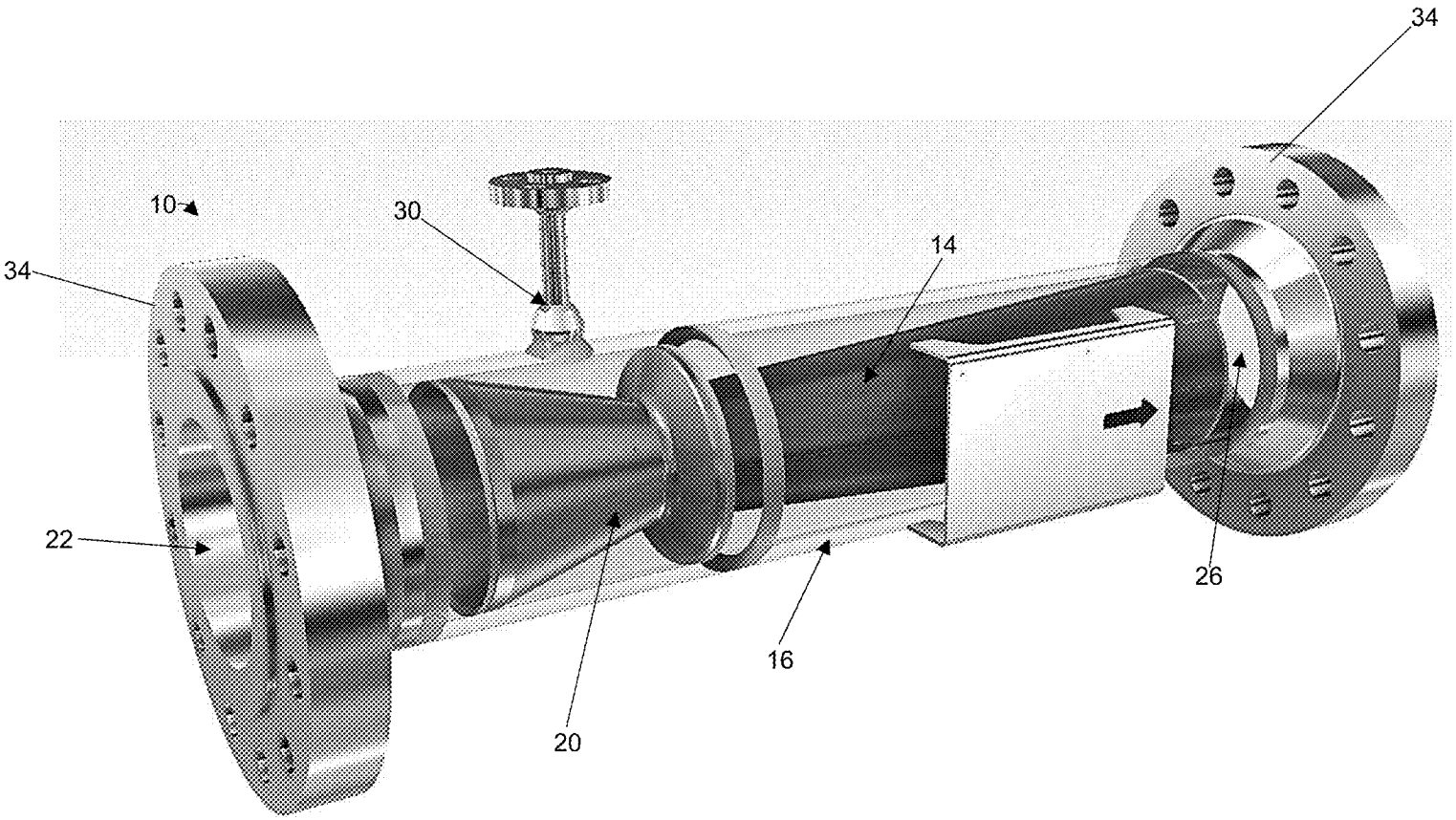
FIG. 2 is a perspective view of a second side of the mixer of FIG. 1.

Referring to FIGS. 1 and 2, shown is a first embodiment 10 of the present injection mixers. Injection mixer 10 can comprise a body 14. Body 14 can comprise a pipe, tube, conduit, channel, or duct such that a fluid may flow through body 14. In some embodiments, body 14 comprises an outer pipe 16. Body 14 may comprise an insert 20. Outer pipe 16 can be substantially cylindrical and, in some embodiments, at least a portion of insert 20 is disposed within outer pipe 16. Outer pipe 16 may define a channel where a portion of insert 20 is disposed within the channel. In some embodiments, insert 20 is completely disposed within the channel defined by outer pipe 16. Insert 20 and outer pipe 16 may be unitary, or, alternatively, can be coupled together to form body 14. Insert 20 and/or outer pipe 16 can be substantially non-planar. In one embodiment, body 14 comprises an interior surface that defines an internal channel 18 having an inlet 22 and an outlet 26. Body 14 may define internal channel 18 or, alternatively, pipe may comprise one or more features that make up internal channel 18. Injection mixer 10 may be configured to transfer a pipe flow where the pipe flow is received at inlet 22 of internal channel 18 and exits injection mixer 10 via outlet 26. The flow may be any multiphase mixture of gas and one or more liquids, a single gas or a combination of gases, any liquid or mixture of miscible liquid components or immiscible components such as hydrocarbon liquid and water. In some other embodiments the flow may comprise a combination any suitable fluid (such as any liquid, gas, or combination thereof). The flow can comprise a fluid mixture that contains solids.

Injection mixer 10 may also comprise an injection assembly 30 coupled to body 14. Injection assembly 30 may be coupled to insert 20 and/or outer pipe 16. In some embodiments, injection assembly 30 is disposed between inlet 22 and outlet 26 of body 14. Fluid communicated through inlet 22 can flow through internal channel 18, where the fluid can be mixed with injected fluids, and thereafter exit body 14 via outlet 26. In some embodiments, injection mixer 10 comprises at least one connector 34. Connector 34 can couple injection mixer 10 to other segments of pipe to form a pipeline. Body 14 may comprise one or more connector(s) 34 having one or more holes by which injection mixer 10 can be connected to another pipe via bolts, screws, anchors, or any other suitable fastener. In other embodiments, connector 34 may couple injection mixer 10 by through any suitable means known in the art.

Figure 3:
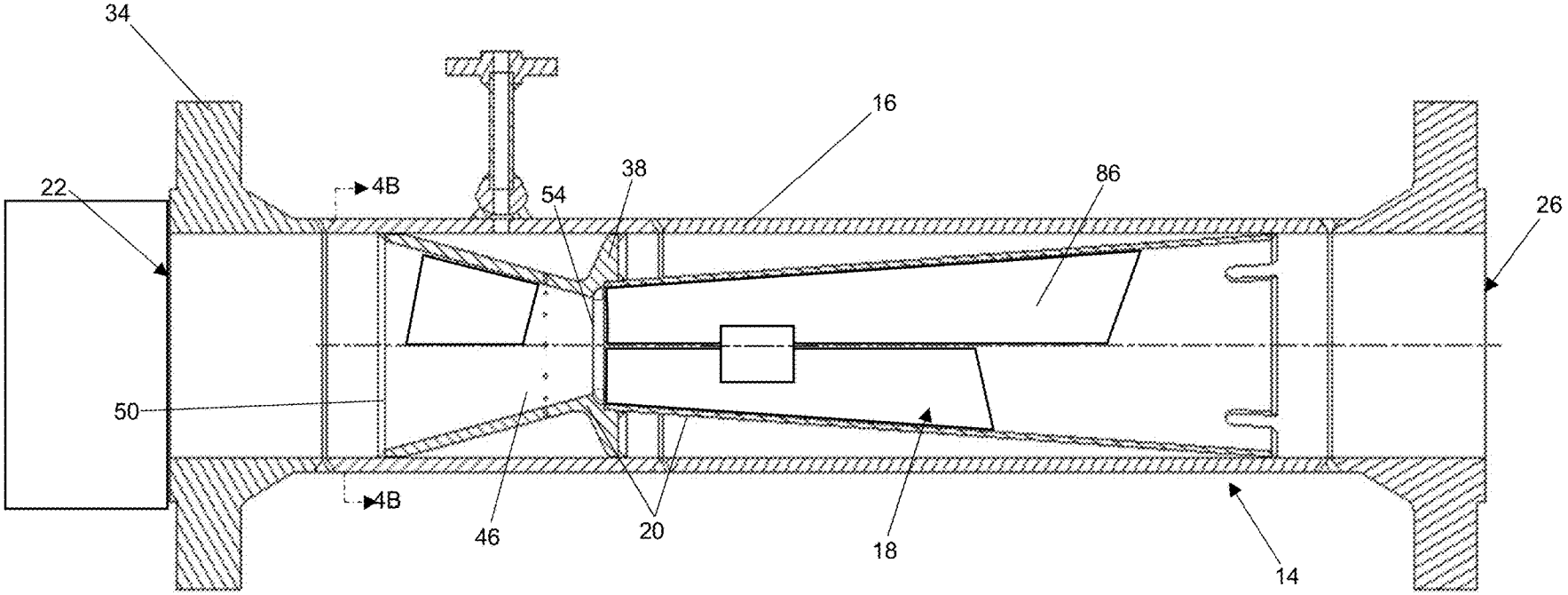
FIG. 3 is a longitudinal cross-sectional view of an embodiment of the mixer.

Referring now to FIG. 3, a cross-sectional view of injection mixer 10 is shown. Outer pipe 16 may comprise a sidewall 38 that defines insert 20. In one embodiment, body 14 comprises an outer pipe 16 that is substantially cylindrical where sidewall 38 extends from an outer surface of outer pipe 16 to an interior surface of body 14 to define internal channel 18. The sidewall may comprise an outer sidewall that defines outer pipe 16 and an inner sidewall that defines the insert 20. In one embodiment, the outer sidewall may define an outer surface of insert 20 and the inner sidewall may define an inner surface of insert 20. In other embodiments, insert 20 may comprise an inner sidewall 38 that defines internal channel 18 of injection mixer 10 where a first fluid 42 may flow. Injection mixer 10 may be configured to efficiently mix first fluid 42 flowing therein with one or more injection fluids. In some embodiments, body 14 may be unitary such that an outer surface of body 14 corresponds to an outer surface of sidewall 38 and an inner surface of body 14 corresponds to an inner surface of sidewall 38.

Body 14 may comprise a convergent portion 46. Insert 20 may define the convergent portion 46 in some embodiments. Convergent portion 46 may comprise an upstream end 50 and a downstream end 54 where inlet 22 is closer to upstream end 50 than to downstream end 54. Convergent portion 46 may comprise an interior surface that defines a portion of internal channel 18. In some embodiments, convergent portion 46 may be conical. Convergent portion may define a tapered frustoconical cone such that the cross-sectional area of internal channel 18 decreases from upstream end 50 to downstream end 54. The decreasing cross-sectional area of internal channel 18 can cause first fluid 42 to accelerate as first fluid 42 approaches downstream end 54 of convergent portion 46. In other embodiments, convergent portion 46 may comprise any suitable shape to allow a fluid flowing through internal channel 18 of body 14 to accelerate. Convergent portion 46 can be configured to increase the velocity of a fluid flowing through internal channel 18 using any suitable means such as, for example, using pumps, changing elevation of the fluid, decreasing cross sectional area of the channel, and/or any other suitable method.

Figure 4A:
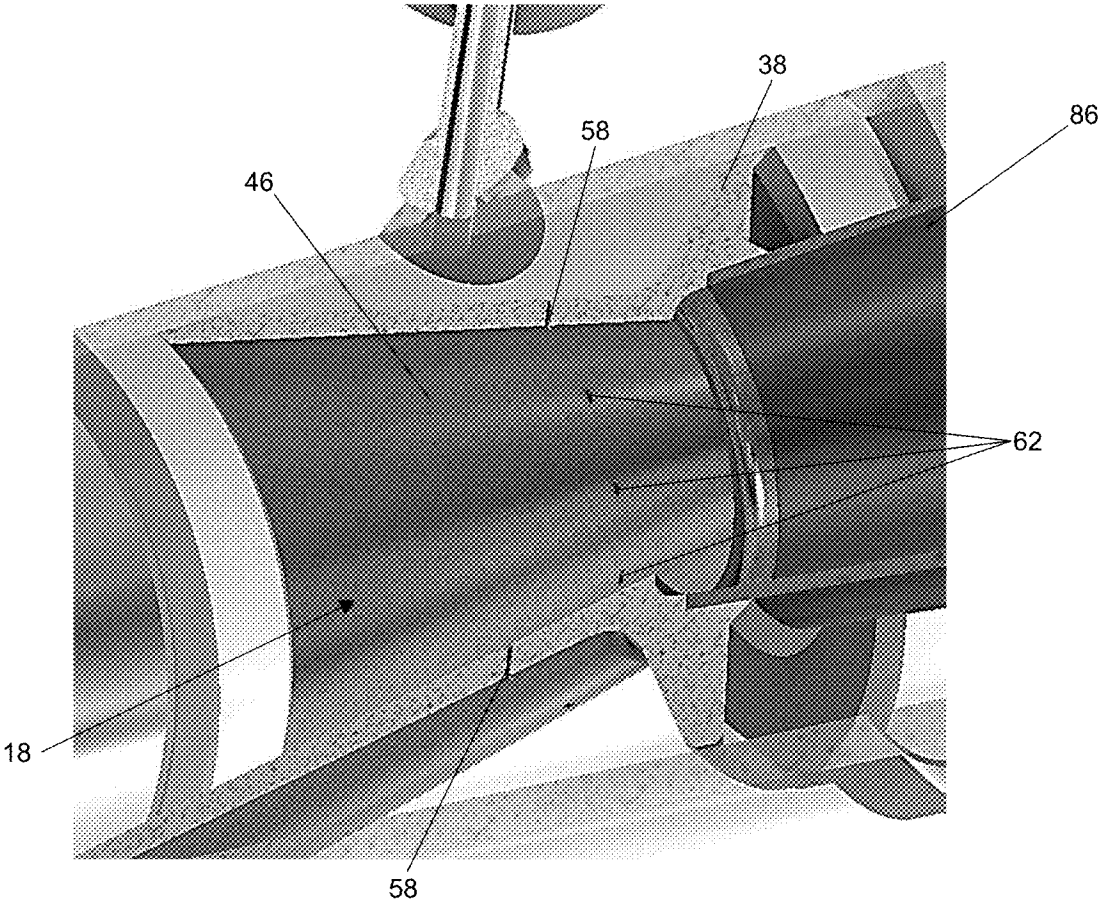
FIG. 4A is a perspective view of the longitudinal cross-sectional view of FIG. 3.
Figure 4C:
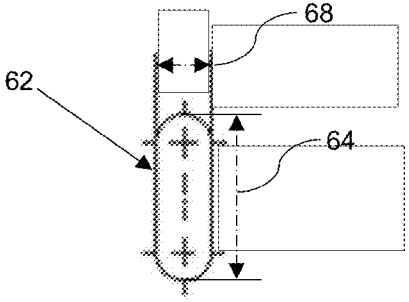
FIG. 4C is an enlarged view of an opening in an exemplary embodiment of the mixer of FIG. 3.
Figure 4B:
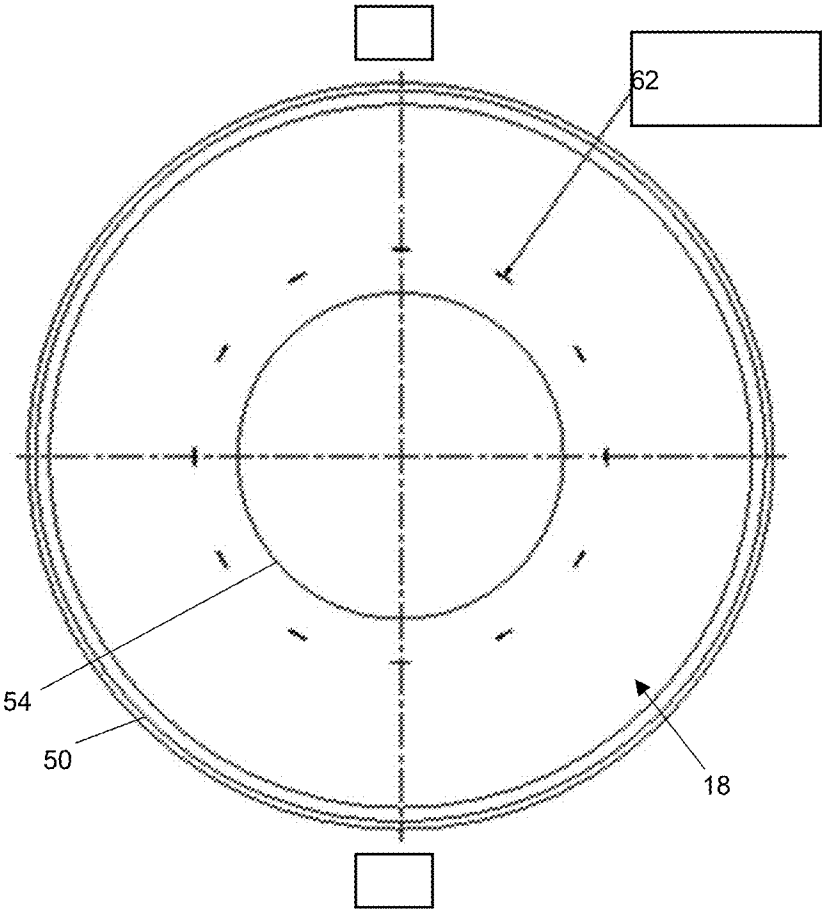
FIG. 4B is a cross-sectional view of the mixer of FIG. 3 taken along line 4B-4B.

Referring now to FIG. 4, an enlarged perspective view of the cross sectional of injection mixer 10 of FIG. 3 is shown. Body 14 may define one or more injection ports 58. Injection port 58 may be defined by insert 20, outer pipe 16, and/or inner sidewall 38. In one embodiment, injection port 58 is configured to communicate a second fluid 66 into internal channel 18. For example, injection port 58 may comprise a conduit that is in fluid communication with injection assembly 30 and internal channel 18 of body 14. Injection mixer 10 may comprise one or more injection port(s) 58. For example, body 14 may comprise between one and twenty injection ports. In another embodiment, body 14 may comprise 20 or more injection ports. In an exemplary embodiment, 12 injection ports 58 may be spaced circumferentially around convergent portion 46, where each injection port 58 is spaced 30 degrees apart, from a longitudinal axis of body 14, from one other injection port 58.

In one embodiment, body 14 comprises a plurality of injection ports 58 spaced circumferentially in convergent portion 46. Each of the plurality of injection ports 58 may have one or more opening(s) 62. Opening 62 may be defined by an aperture in an interior surface of body 14. At least one injection port 58 may extend through the interior surface of body 14 to define opening(s) 62. In one embodiment, injection port(s) 58 may extend through insert 20 to define opening(s). Opening(s) 62 may be defined by convergent portion 46 of body 14. Opening(s) 62 may comprise a first dimension 64 in a circumferential direction and a second dimension 68 in a longitudinal direction of internal channel 18, where the circumferential direction and longitudinal direction are substantially perpendicular. In one embodiment, first dimension 64 of opening 62 is larger than second dimension 68 of opening 62.

First dimension 64 may have a length that is greater than a length of second dimension 68 such that, for example, a length of first dimension 64 is any of or between any of 150%, 175%, 200%, 250%, 300%, 350% or 400% the length of second dimension 68. In an illustrative embodiment, first dimension 64 of opening 62 is between 2-20 millimeters (mm) and second dimension 68 is between 0.1 and 5 mm. In other embodiments, first dimension 64 of opening 62 may be equal to, or between any two of: 0.5, 1.0, 2.0, 5.0, 6.0, 7.5, 10.0, 12.5, 15 and/or 20 mm. In some embodiments, opening 62 defines narrow rectangular slits arranged circumferentially around internal channel 18. In this way, the fluid (e.g., 66) injected through opening 62 may be dispersed on inner surface of convergent portion 46 and dispersed into internal channel 18 via first fluid 42 (e.g., shear stress) flowing through injection mixer 10. The openings are shaped and sized, as described herein, to create a layer of injected fluid (e.g., 66) that has a thickness less than that of typical injection mixers. In this way, fluid break up may be increased (e.g., by heat and mass transfer of first fluid 42) and mixture of the fluids may occur at a shorter distance downstream from the opening (e.g, 62) than compared to current injection mixers.

Opening(s) 62 may not be perfectly rectangular and may by curved at a circumferential end. Opening 62 may comprise a first side and a second side. In one embodiment, the first and second sides are linear. The first and second sides may also be parallel to one another. Opening 62 may also comprise a third side and fourth side that connect the first and second side to define opening 62. Third and fourth sides may be arcuate in some embodiments and linear in other embodiments. Opening 62 may also be defined by an elliptical boundary such as an oval. In some embodiments, injection port 58 may comprise an opening 62 that may define any suitable geometry, such as, for example a circle, an oval, a triangle, quadrilateral, a polygon, and/or any other shape or combination of shapes thereof having a greater length in a circumferential direction than in a longitudinal direction. First and second dimension (64, 68) may be varied to generate desired mixing of the fluids based on injection requirements and characteristics of the mixing fluids and pipe flow.

Figure 5:
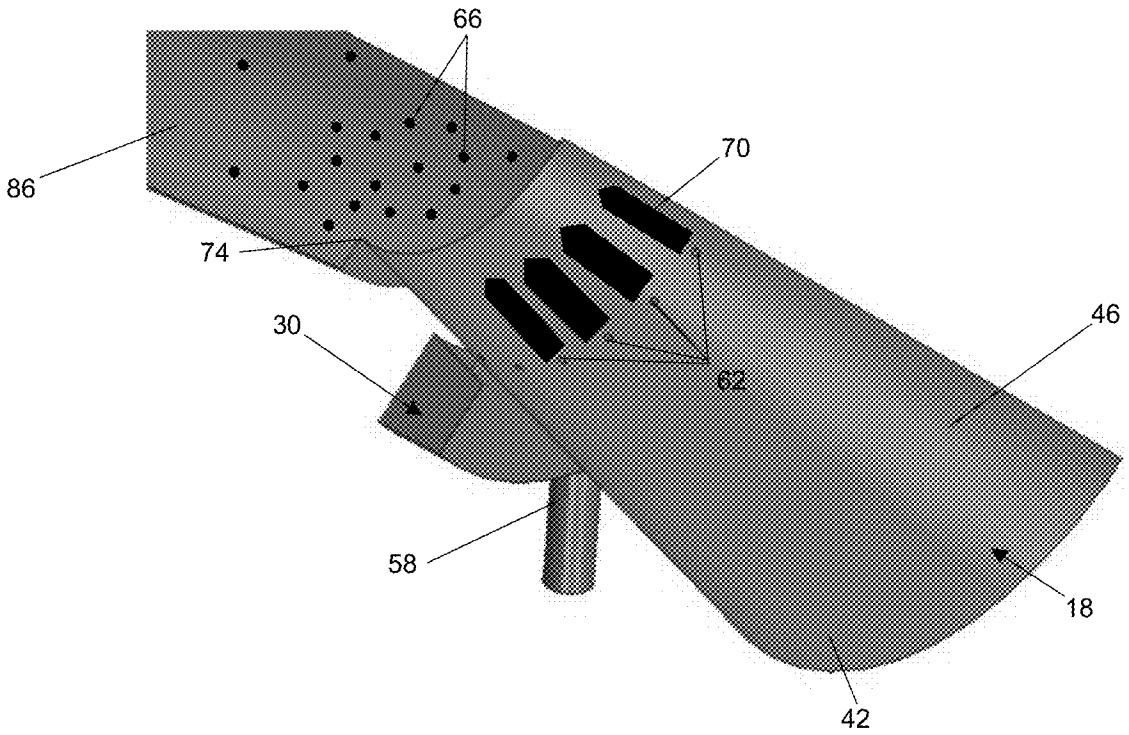
FIG. 5 is a perspective view of the interior of an embodiment of the mixer during a mixing process.
Figure 6:
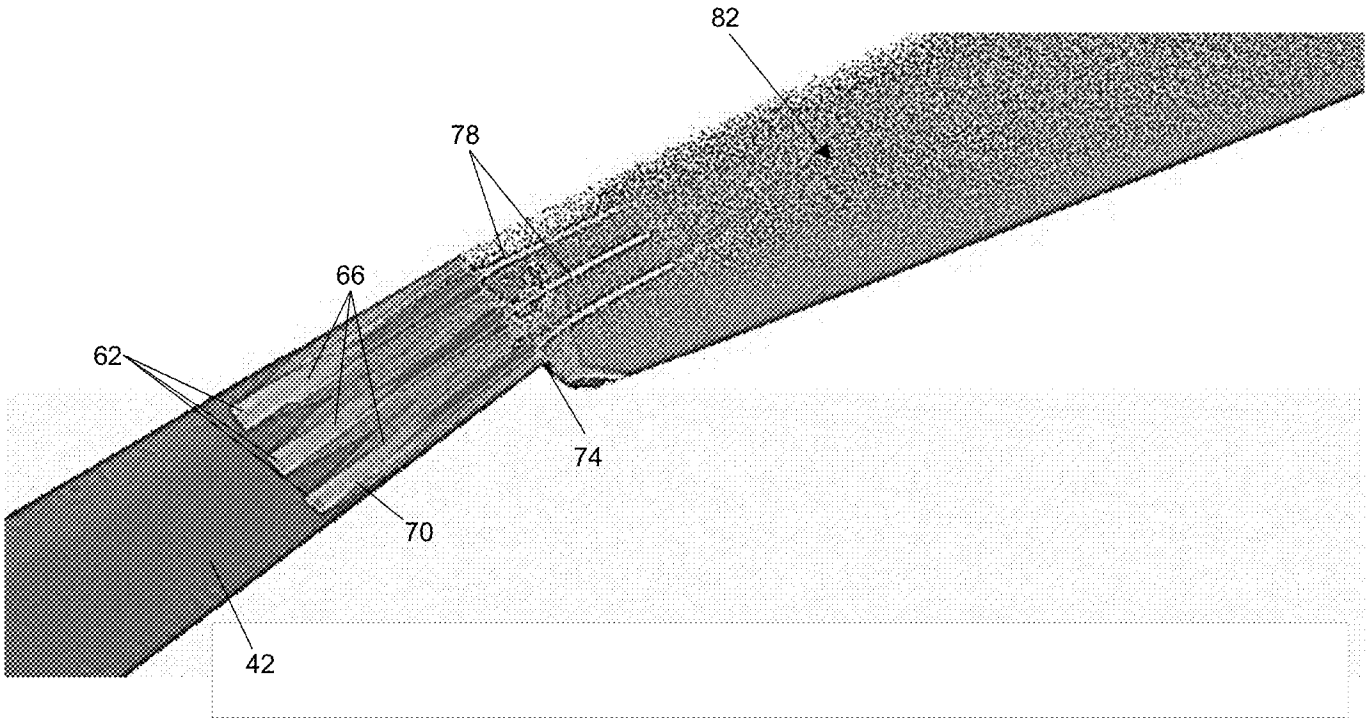
FIG. 6 is a perspective view of the interior of an embodiment of the mixer during a simulated mixing process of two fluids.
Figure 7:
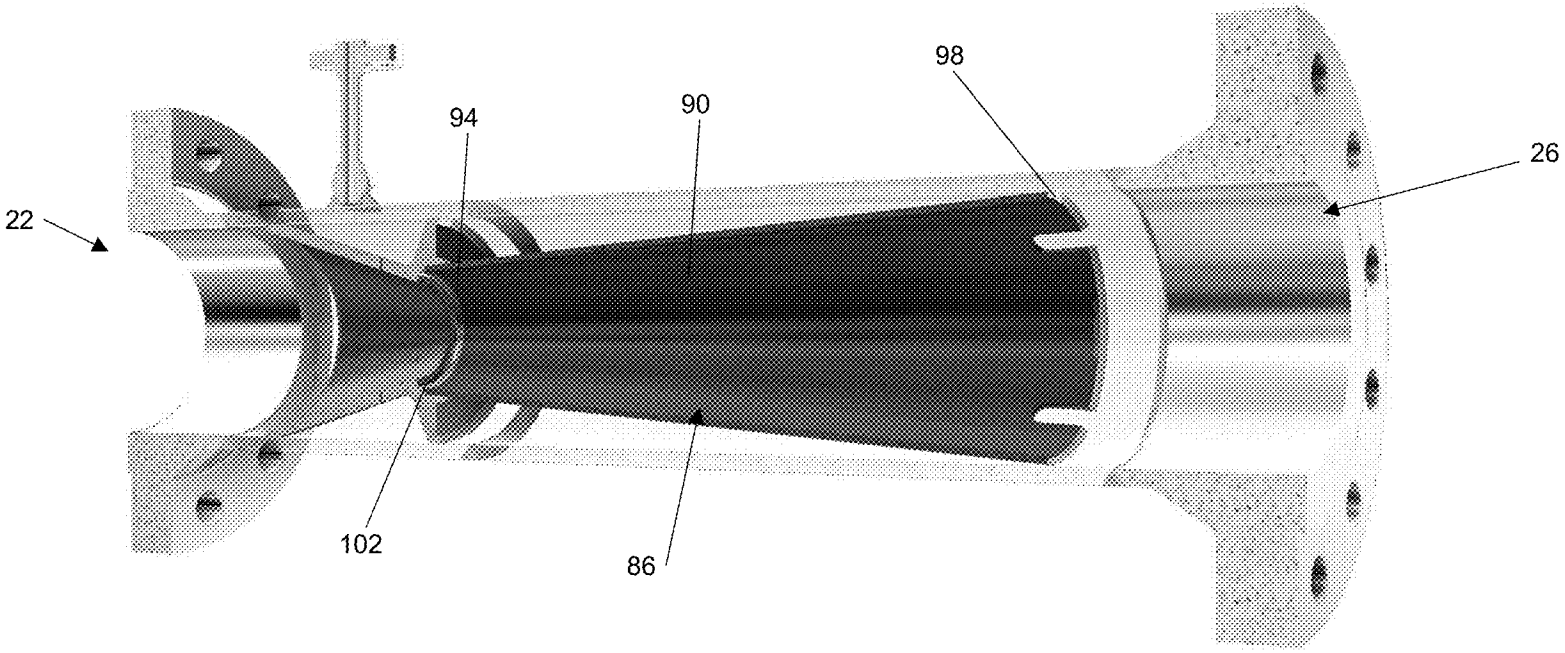
FIG. 7 is another cross-sectional view of an embodiment of the mixer.

As shown in FIGS. 5 and 6, injection port(s) 58 may be configured to inject a second fluid 66 into internal channel 18 such that the second fluid forms a thin film 70 on a surface of convergent portion 46 of body 14. Second fluid 66 may be introduced into internal channel 18 via opening 62 of injection port 58. Second fluid 66 may be introduced from injection port 58 at a gradual rate such that a majority of second fluid 66 forms film 70 on the interior surface of body 14, rather than being dispersed into an interior of internal channel 18. In some embodiments, the restricted pipe flow generated by convergent portion 46 encourages the formation of film 70 on the surface of inner channel (e.g., 18) downstream from injection port 58. A larger first dimension 64 may mitigate uneven distribution of film (e.g., 70) on a surface of internal channel 18. For example, typical openings of injection mixers having large circular hole may cause fanning of second fluid 66 from momentum transfer of first fluid 42. Fanning can cause a deeper film to form with uneven fluid distribution (e.g., fluid height is greater at the center and/or edges of the film). This deep film can lead to poor mixing in injection mixer 10. Conversely, openings 62 of injection mixer 10 are sized such that film 70 is evenly distributed and entrainment of the injected fluid (e.g., 66) is increased. To illustrate, first dimension 64 may be greater than second dimension 68 to allow increased break-up of the injected fluid. Additionally, or alternatively, openings 62 may be sized (e.g., rectangular) for even distribution of film 70 and increased mixing characteristics.

In some embodiments of injection mixer 10, film 70 of second fluid 66 is broken up into droplets. The droplets may then mix with first fluid 42 to form a fluid mixture 82. A shear edge 74 may be defined by downstream end 54 of convergent portion 46. A stream 78 of second fluid 66 can occur as second fluid 66 passes shear edge 74. The stream 78 may comprise second fluid 66 that was not broken up into individual droplets after passing shear edge 74. A large stream 78 may decrease heat and mass transfer of the droplets and reduce mixing properties. In fluid mixers with thick or uneven film formation, a large stream may be generated. The stream may be too large to effectively breakup into droplets before a certain distance downstream (e.g. 30 meters). Opening 62 of injection mixer may be configured to reduce stream 78 size or eliminate formation of stream 78 altogether. For example, in some embodiments, opening 62 can generate a film 70 with a thickness of 0.08 millimeters (mm) or less that is atomized after passing over shear edge 74 to be broken up in divergent portion 86 of internal channel 18. In some embodiments, first dimension 64 of opening 62 has a length 2-3 mm and second dimension 68 of opening 62 is varied based upon injection requirements for the particular system and optimal radial positioning along the circumference of internal channel 18. In some embodiments, Opening 62 is any suitable dimension to optimize film thickness according to the length and width of body 14 to ensure complete liquid droplet breakup.

The decreasing cross-sectional area can cause first fluid 42 flowing through internal channel to accelerate as first fluid 42 approaches shear edge 74. The increased fluid velocity can facilitate the generation and break-up of the injected fluid(s). To illustrate, droplet generation is a function of the relative velocity (U) between first fluid 42 and the injected fluid(s), in addition to the geometry of shear edge 74 and the surface tension between the different fluids. The accelerated first fluid 42 can, for example, entrain the injected fluid(s) along the surface of the convergent portion 46 of internal channel 18 and over shear edge 74 to promote droplet formation.

The increased first fluid 42 velocity in internal channel 18 can promote the breaking up of injection fluid into high surface area droplets. Principles governing turbulent mixing to promote droplet generation and break up are described in U.S. Pat. No. 9,295,953, which is hereby incorporated by reference in its entirety. Droplet break-up is governed at least in part by the Weber number (We) of the fluid:

$$We = \frac{\rho U^2 d}{\sigma}$$

where ρ is the density of the first fluid flowing through the mixing channel, U is the relative velocity between the first fluid and the injected fluid(s), d is the characteristic droplet dimension, and a is the surface tension between the first fluid and the injected fluid(s). Fluid break-up occurs when We exceeds the critical Weber number ($We_{cr}$). At least for wind tunnel experiments and droplet injection into the flow field, $We_{cr}$ can be, for example, between 8 and 10. Because We is proportional to the square of the relative velocity between first fluid 42 and second fluid 66, the acceleration of first fluid 42 from convergent portion 46 of internal channel 18 can significantly increase the break-up of the fluids and droplets to improve mixing efficiency.

The increased first fluid 42 velocity resulting from convergent portion 46 can also facilitate efficient mixing by promoting droplet dispersion across the cross-section of divergent portion. Droplet dispersion is at least in part a function of the Reynolds number (Re) of fluid mixture 82:

$$\mathrm{Re} = \frac{\rho_m U_m D}{\mu_m}$$

where D is the local conduit diameter, $U_m$ is the local mixture velocity, and $\rho_m$ and $\rho_m$ are the density and viscosity of fluid mixture 82, respectively. The first fluid's 42 increased velocity can increase the Reynolds number of the system and thus improve radial droplet dispersion across the cross-section of divergent portion. Such dispersion promotes efficient mixing, at least by preventing a concentration of the injected fluid(s) in the center of internal channel 18.

Placement of injection port(s) 58 can similarly facilitate droplet generation and break-up by increasing the Weber number for the fluids in injection mixer 10. Moving opening 62 of injection port 58 closer to shear edge 74 can result in a decrease of the velocity of second fluid 66 as it enters internal channel 18, consequentially increasing the relative velocity of the fluids. In some embodiments, the velocity of first fluid 42 (e.g., $V_{gas}$) and velocity of second fluid 66 (e.g., $V_{liquid}$) can be controlled by changing the position of injection port(s) 58 in relation to shear edge 74. The closer injection port(s) 58 are to shear edge 74, the lower the velocity of second fluid 66, resulting in a higher relative velocity and Weber number. This higher Weber number can enhance fluid break-up and decrease the amount of liquid that remains in the pipe flow downstream from injection mixer 10. Since not all applications will require 100% evaporation, but 100% adsorption plus separation downstream, the geometry of opening 62 and positioning of injection port 58 relative to shear edge 74 can be manipulated to achieve desired results for a particular system. This is particularly important in mixers with fixed gas velocity or lower gas velocity constraints. Reduction of film velocity of the injection fluid can allow for fluid break-up in systems with a low gas velocity of a process flow. Injection mixer 10 can still exceed the critical Weber number required for full evaporation of the liquid in these low velocity pipes.

In some embodiments, injection mixer 10 can produce turbulent mixing of first fluid 42 and second fluid 66 to promote efficient mixing. The geometry of internal channel 18 can facilitate this efficient, turbulent mixing. A divergent portion 86 of body 14 may be configured to increase the Reynolds number sufficiently such that turbulent flow is induced in first fluid 42 and/or fluid mixture 82 as it flows through internal channel 18. For example, body 14 may comprise a divergent portion 86 that is conical. In one embodiment, insert 20 comprises divergent portion 86. Divergent portion 86 may comprise an interior surface that defines a portion of internal channel 18. A transverse dimension of at least a portion of internal channel 18 defined by divergent portion 86 may be larger than a transverse dimension of at least a portion of internal channel 18 defined by convergent portion 46 to cause a pressure drop such that the Reynolds number of the pipe flow is increases above the critical Reynolds number. In one embodiment, the critical Reynolds number is equal to or more than 2,900 while in other embodiments the critical Reynolds number is lower than 2,900 such as, for example, between 2,000 and 2,900.

In some embodiments of injection mixer 10, divergent portion 86 comprises a divergent frustoconical portion 90 having an upstream end 94 and a downstream end 98. Divergent portion 86 may also comprise a concave curved portion 102. Divergent frustoconical portion 90 may define a frustoconical cone having a cross-sectional area that increases from upstream end 94 to downstream end 98. In one embodiment, outlet 26 may be closer to downstream end 98 than upstream end 94. The expanding cross-sectional area can cause first fluid 42 and/or second fluid 66 to decelerate as the fluid approaches downstream end 98 of divergent portion 86.

Figure 8:
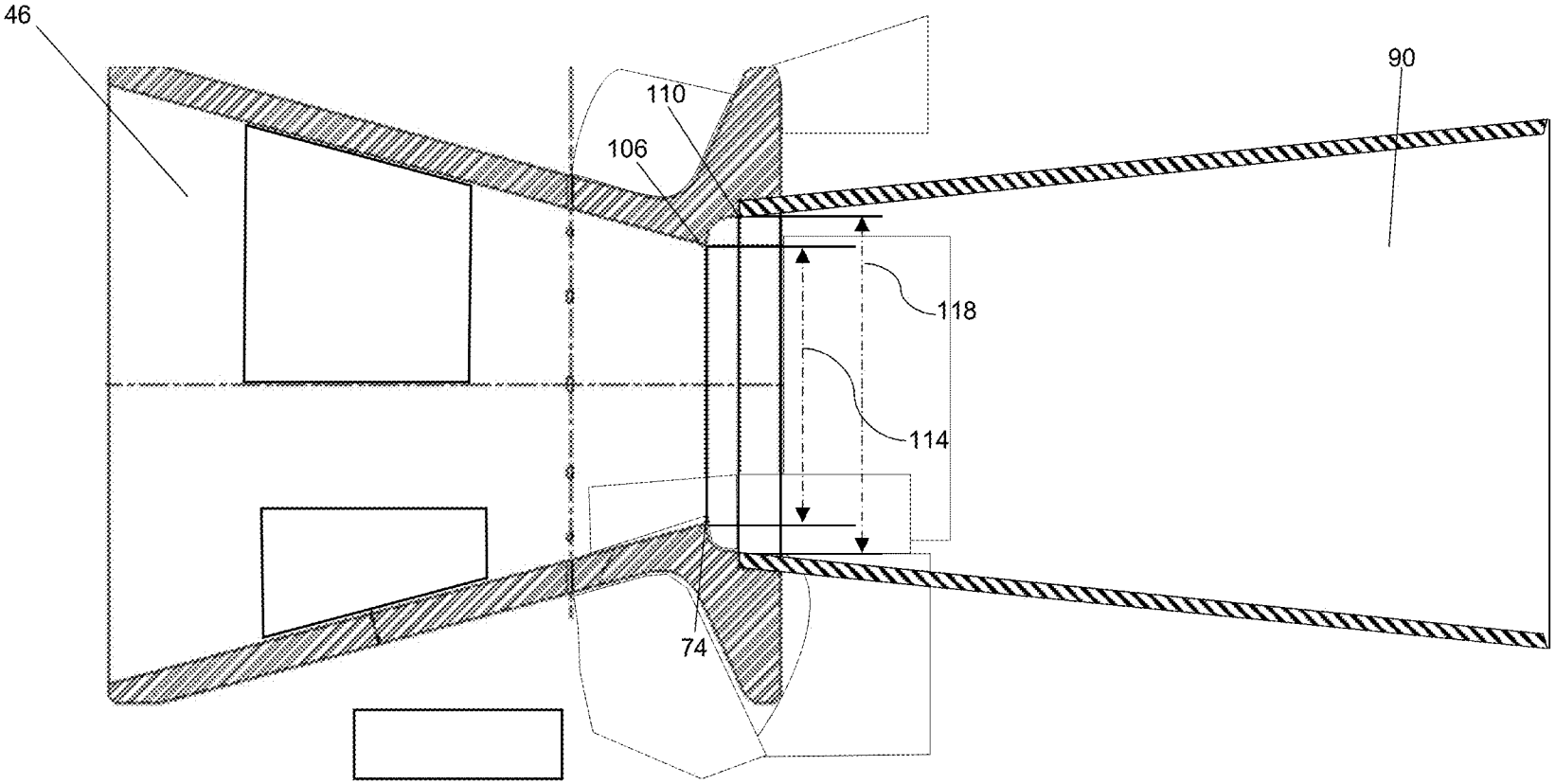
FIG. 8 is an enlarged cross-sectional view of FIG. 7.

As shown in FIG. 8, concave curved portion 102 may be an annular portion of divergent portion 86 that is concavely curved from a first end 106 to a second end 110. In some embodiments, concave curved portion 102 may define a portion of internal channel 18 extending from downstream end 54 of convergent portion 46 to upstream end 94 of divergent frustoconical portion 90.

The intersection of convergent portion 46 and divergent portion 86 may also facilitate droplet generation and second fluid 66 break-up. In some embodiments, as first fluid 42 flows through injection mixer 10, from inlet 22 to outlet 26, first fluid 42 exits convergent portion 46 as it enters divergent portion 86. In some embodiments, downstream end 54 of convergent portion 46 defines a first inside diameter 114 of internal channel 18 and upstream end 94 of divergent frustoconical portion 90 defines a second inside diameter 118 of internal channel. In an exemplary embodiment, shown in FIG. 8, first inside diameter 114 is smaller than second inside diameter 118. First inside diameter 114 may be a minimum transverse dimension of the interior surface of convergent portion 46 of body 14. Second inside diameter 118 may be a minimum transverse dimension of the interior surface of divergent frustoconical portion 90 of body 14. A transverse dimension of internal channel 18 at first end 106 of concave curved portion 102 may correspond to first inside diameter 114 and a transverse dimension of internal channel 18 at second end 110 of concave curved portion 102 may correspond to second inside diameter 118.

Similarly, a first cross-sectional area of internal channel 18 at a first end 106 of concave curved portion 102 may be smaller than a second cross-sectional area of internal channel 18 at a second end 110 of concave curved portion 102. In one embodiment, the first cross-sectional area may be at least 5%, 10%, 20%, 30%, 40%, 50%, 60%, or 70% smaller than the second cross-sectional area. In one embodiment, shear edge 74 is defined by the intersection of convergent portion 46 and divergent portion 86. More specifically, shear edge 74 may be defined by downstream end 54 of convergent portion 46 and the first end 106 of concave curved portion 102. In some embodiments shear edge 74 may comprise an angle 122. The angle may be defined as an angle 122 between internal channel 18 extending from first end 106 of concave curved portion 102 toward divergent frustoconical portion 90 and internal channel 18 extending from downstream end 54 of convergent portion 46 toward inlet 22. In one embodiment, angle 122 may be acute (e.g. less than 90 degrees) to provide a relatively steeper edge that may increase shear stress and improve the breaking off of viscous liquids at shear edge 74. The steeper edge can provide higher stresses to the injection liquid to improve break-up of film 70 such that the resulting droplets have a smaller surface area.

The increase in the cross-sectional area of internal channel 18 downstream from shear edge 74 may generate turbulent flow in first fluid 42 and/or fluid mixture 82 to enhance mixing characteristics. Angle 122 may be configured in any suitable manner to disperse second fluid 66 into divergent portion 86 of internal channel 18. In some embodiments, angle 122 may be obtuse (e.g. 90° or more) for less viscous fluids, which may not require an acute angle for droplet formation. As second fluid 66 passes over shear edge 74, the second fluid can break off from the surface of internal channel 18 to form droplets of second fluid 66. Dispersion or atomization of second fluid 66 can occur from shear stresses acting on film 70 of second fluid 66 as the film passes shear edge 74. Droplet formation may also occur due to the Weber number of the first fluid 42 and second fluid 66. In some embodiments, for example, the droplets of second fluid 66 dispersed at shear edge 74 may have a diameter equal to or between 300 and 4,000 microns (μm). In one embodiment, second fluid 66 may be completely dispersed into droplets at shear edge 74 so that stream 78 is not formed during mixing. The droplets may then be carried through divergent portion 86 of internal channel 18 by first fluid 42 and/or fluid mixture 82.

After passing shear edge 74, the droplets may be further dispersed or evaporated due to heat and momentum transfer from first fluid 42. This secondary breakup can occur, at least in part due to the droplets relatively large surface area to volume ratio. In some embodiments, film 70 of second fluid 66 forms a stream 78 that may extend downstream into divergent portion 86 of body 14 during the mixing process. Stream 78 may subsequently be broken up, or dispersed, into secondary droplets as it travels further downstream (e.g., toward downstream end 98 of divergent frustoconical portion 90). This secondary breakup may occur from heat and mass transfer by first fluid (e.g., 42) onto stream 78. Secondary breakup may occur after a droplet exceeds a critical Weber number. For example, dispersion of stream 78 may occur due to the Weber number, relative velocities of the gas flow, shear stress, and/or heat transfer as second fluid 66 passes shear edge 74 and travels through divergent portion 86. Secondary breakup may completely disperse stream 78 into secondary droplets, which have a smaller surface area of fluid to allow for more complete mixing.

Secondary breakup may disperse a plurality of droplets. In one embodiment, for example, each of the plurality of droplets of second fluid 66 may have a diameter between 0 and 1,000 microns (μm). More specifically, a majority of the plurality of droplets of second fluid 66 formed during secondary breakup may have a diameter between 10 and 400 microns (μm). The secondary breakup allows for adequate dispersion of the second fluid 66 and, in turn, full evaporation of second fluid 66 so that fluid mixture 82 is in a completely gaseous state.

Figure 9:
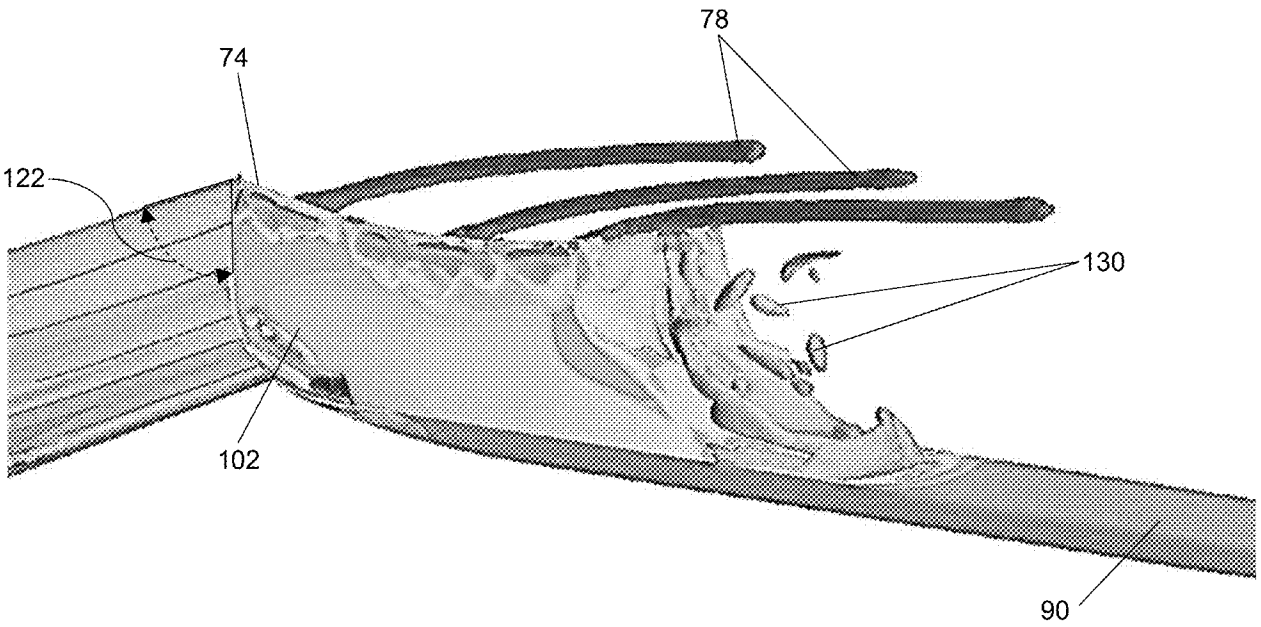
FIG. 9 is an enlarged view of a concave curved portion the mixer during a simulated mixing process of two fluids.

Referring to FIG. 9, residual droplets 130 of second fluid 66 may form immediately downstream from shear edge 74. Residual droplets may be an accumulation of liquid that remains in divergent portion 86 of internal channel 18. More specifically, residual droplets 130 may accumulate in immediately after shear edge 74. Residual droplets 130 may occur when droplet size is too large such that less than 100% of second fluid 66 is dispersed in the pipe flow. In some embodiments of injection mixer 10, concave curved portion 102 may eliminate residual droplet 130 accumulation in internal channel 18. Concave curved portion 102 may be positioned to retain the larger residual droplets 130 where secondary breakup of the residual droplets may occur. Concave curved portion 102 may be configured to re-entrain any residual droplets 130 that may form. For example, concave curved portion 102 may induce backflow re-circulation of first fluid 42 and/or fluid mixture 82 in divergent portion 86 of internal channel 18 to redistribute residual droplets 130. The backflow re-circulation may comprise a vortex, eddie, gas instability, and/or any other kind of turbulent gas flow. In some embodiments, the backflow re-circulation causes secondary breakup of residual droplets 130. Backflow re-circulation may cause first fluid 42 to have increase velocity at a surface of concave curved portion 102, depicted in FIG. 9. This may cause the residual droplets 130 to be dispersed and entrained in the pipe flow which may cause further breakup and complete mixing.

Injection mixer 10 may be configured to disperse and/or evaporate substantially all of the injected second fluid 66 before fluid mixture 82 travels a specified length of downstream from the shear edge 74 (e.g., 30 m). In some embodiments, the complete dispersion and mixing or evaporation of second fluid 66 occurs less than 30 meters downstream from shear edge 74. Complete mixing and/or evaporation of second fluid may occur at or between the following distances from shear edge: 1, 3, 5, 8, 10, 15, 20, 25, 30, 40 and/or 50 meters (m).

After break-up occurs, second fluid 66 and can intimately mix with first fluid 42 to form a fluid mixture 82. Upon entering divergent portion 86 fluid mixture 82 and first fluid 42 may decelerate as it flows to outlet 26. In some embodiments, the expanding cross-sectional area of divergent frustoconical portion 90 may cause the pressure of the pipe flow to increase to recover some of the pressure lost due to the pressure drop at shear edge 74. Thus, divergent frustoconical portion 90 can reduce permanent pressure drop across injection mixer 10. The reduced pressure drop can save energy and eliminate the need to reverse the pressure drop before entering the compression stage. Injection mixer 10 can be configured to adjust the pipe flow through mixer in response to changes in fluid flow rate to ensure proper mixing.

Advantageously, each of convergent portion 46, divergent portion 86, injection assembly 30, and the respective components thereof, can be disposed within body 14. Body 14 can be readily coupled to another fluid-carrying pipe (e.g., to a pipeline) via the one or more connector(s) 34. Injection mixer, at least in part due to its simplicity, can thereby provide cost-effective and reliable mixing.

Injection mixer 10 can be used to mix any suitable combination of fluids. For example, injection mixer 10 can be configured to inject and mix one or more fluids, such as gases and/or one or more liquids into a gas and/or into a liquid communicated from the inlet. To illustrate, and without limitation, injection mixer 10 can be configured to receive and mix one or more hydrocarbons (e.g., oil and/or gas, condensate, liquefied natural gas, natural gas liquids, natural gas feedstock, chemical feedstock and/or other gases) and/or water with the injected fluid(s). The injected fluid(s) can comprise one or more chemicals, solvents, additives, extraction fluids, and/or other hydrocarbons such as methane, propane, butane and/or heavier hydrocarbons. To illustrate, and without limitation, the injected fluid(s) can comprise a scavenger or irreversible solvent (e.g., to remove sour constituents such as $H_2S$), a corrosion inhibitor, a hydrate inhibitor, a scale inhibitor, a wax inhibitor, a drag reducer, a de-emulsifier, a deoiler, a defoamer, an antifoulant, a flocculant, a condensate or hydrocarbon, a gas, and/or water.

Injection mixer 10 may be advantageous over other fluidic mixers for several applications. In one embodiment, positioning of injection port(s) 58 and dimension of opening(s) 62 may allow full dispersion and mixing and/or evaporation for a wide range of NGL flowrates, in combination with a wide range of LNG feedstock flowrates over a range of temperature conditions. This alleviates the expenses typically associated with fluid mixers, such as, for example, heaters to enhance evaporation, frequent maintenance from liquid flowing into compressors, equipment depreciation from solid and liquid adherence to blades of the compressor, reversing large pressure drops, and other known issues associated with fluid mixing in a pipe flow.

In one example, injection mixer 10 may be specifically beneficially for Crude Distillation Unit (CDU) Overhead Line Wash Water injection. The CDU is the first fractionation column that raw crude enters, where different hydrocarbons may be separated by boiling points, such as, for example, naphtha, diesel range, kerosene, jet fuel, bottoms and/or any other hydrocarbon ranges. In most instances salt is present in the raw crude, from brine waters produced with the raw crude from the underground production formation. The salt can be removed through a desalting process where low salinity water, specifically water with low chloride content, is added to the raw crude to act as a dilution mechanism for the brine present in the raw crude. As complete removal of these salts is impossible, refiners must address the salts that enter the CDU. One specific method for dealing with chloride salts that have entered the CDU is to assume thermal hydrolysis in the CDU and carryover of the chloride salts as HCl into the overhead line coming from the top of the CDU. These HCl salts can corrode the overhead line, causing unforeseen shutdowns and loss of production revenue for the refiner.

To eliminate or lessen the corrosive nature of the HCl, refiners will opt to inject either wash water to absorb and further dilute the HCl, or inject amines to adjust the pH of the resultant liquid to neutralize the low pH of the HCl condensate. In either injection application, the requirement for a high efficiency injection mixer is needed to effectively dilute or neutralize the HCl. Injection mixer 10 may fully utilize all of the injection fluid that is added into the channel such that no residual injection fluid remains in the pipe. This may eliminate the possibility of concentrated salt build up in zones of poor mixing, and reduce the water dropout in areas of high corrosion, such as along the bottom of the overhead line. Comparative injection mixers for injecting chemicals or wash water typically use a single injection point unit, such as an atomizer and quill, and provide poor efficiency of mixing in the overhead line system. The use of injection mixer 10 can increase the efficiency of the chemical and/or water injection, thus reducing chloride salt corrosion in overhead lines, and avoiding costly unexpected downtime for the refiner.

In another example, injection mixer 10 may be specifically beneficial for hydrotreaters used during refining operations. In a hydrodesulfurization refining process, $H_2$ gas is mixed with the various distillates at high temperatures, 500 to 750 degrees Fahrenheit, and fed into a catalyst bed. The catalyst and heat will force the hydrogenation, denitrogenation, as well as the desulfurization of the various fuels in the raw crude. The mixture is then cooled, where the liquids are allowed to separate and the gas is further processed to remove $H_2S$ and ammonia, and the resulting $H_2$ is sent back into a hydrotreater feed stream for further reaction. During this process, it is common for ammonia bi-sulfide salts and/or other corrosive salts to form at an outlet line of the hydrotreating unit. These salts can cause corrosion in the hydrotreater, such as for example the salt may corrode the pipes, shell and tube coolers, and/or other heat exchange units in the hydrotreater. A water wash is typically used to remove the various salts from the system and avoid unscheduled shutdowns of the unit.

The wash water injection requires even distribution of the water in order to avoid pooling salt, or an uneven distribution of salt in the wash water creating a salt-rich mixture in some tubes while leaving other tubes virtually salt free. Additionally, the salts formed may be corrosive in their solid state, and poor use of wash water allows for salt accumulation in certain zones. The plurality of injection ports 58 of injection mixer 10 may be configured to create an even distribution of liquid in the pipe flow and proper suspension of a liquid in a flowing gas stream. This will improve the removal of salts from the system, thus avoiding corrosion. In addition, concave curved portion 102 may prevent the accumulation of caused by poor mixing, as described in more detail below.

In another example, injection mixer 10 may be specifically beneficial for desuperheating in industrial processes. In industrial and refining processes steam is often taken from a superheated form and reduced to the saturated steam temperature. In order to desuperheat the steam, water is injected into the superheated stream, which causes vaporization of the water and ultimately lowers the process fluid temperature. Water is typically injected at a temperature close to the saturated steam temperature to minimize liquid suspension and avoid liquid build up along the pipe walls. It is also important to create dispersed water droplets that can efficiently absorb the heat from the superheated steam stream. The geometry of the plurality of injection ports and concave curved portion of the inner channel reduce the risk of water buildup along pipe walls. The injection ports 58 and opening 62 allow for greater distribution of the injected water droplets while the concave curved portion 102 allows any residual droplet buildup on the pipe wall to be re-entrained into the pipe flow. The greater distribution of the water droplets increases the vaporization rate and allows for better temperature control of the desuperheater stream.

In another example, injection mixer 10 may be specifically beneficial in natural gas dehydration, hydrate inhibition, and acid gas removal. Natural gas production often requires several levels of process separation before midstream providers will accept the quality of natural gas. These process separations can involve the removal of several components, such as water, $CO_2$, $N_2$, and/or $H_2S$. The injection of methanol or glycols may be required to remove water from the natural gas stream or prevent the formation of solid hydrates. Acid gas, such as $CO_2$ and $H_2S$ is also required to be removed. The removal of $CO_2$ and $H_2S$ is completed with amines, some of which can be re-used, such as MDEA, and others that are single use, such as triazine.

In each of the above applications, the injection of a liquid into a gas is required, where the liquid acts as an absorbent for the component targeted for removal. Therefore, it is important to create as much mass transfer surface area with the injected liquid and natural gas in order to achieve efficient use of the absorbent.

The optimized mass transfer of injection fluids found in injection mixer 10 will guarantee the proper dispersion and diffusion of the liquid into the gas streams, avoiding local buildup of liquids where poor mass transfer would take place. In these applications, it is not only important to increase mass transfer area through proper dispersion, but also important is to create a droplet distribution that is easily removed from the natural stream. Injection mixer 10 may also reduce liquid droplet carryover into the natural gas stream after the targeted component has been removed.

Injection mixer 10 may also provide benefits for process such as, by way of example, without limitation, salt removal from vapor distillates, viscosity control of a process flow, oxygenating gasoline, de-sulfurization processes, dehydrating processes, mixing fuel additives, mercaptan removal, methanol removal from crude, hydrotreating, hydrate inhibition in natural gas flows, gas dehydration, salt removal from distillates, dew point control processes, Carbon dioxide scavenging, deoxygenation of a an aqueous flow, temperature control for water mixing, salinity control processes, hydrocarbon extraction, PH control, iron removal, bacterial control/disinfection, flow assurance for chemical injection processes, viscosity control for blending polymers in an aqueous flow, and/or any other known process for mixing, separating, blending, injecting and/or evaporating fluids.

The methods for mixing two or more fluids can include using any injection mixer 10, in at least any of the ways described above. Some methods, for example, comprise a step of receiving a first fluid 42 through an inlet 22 of injection mixer 10. First fluid 42 can be, for example, natural gas or a liquefied natural gas feedstock. In some methods, first fluid 42 is communicated though convergent portion 46 of internal channel 18. In one method, communicating can include accelerating first fluid 42 through convergent portion 46 (e.g., if a cross-sectional area of the inlet channel decreases in a downstream direction, as described above).

Some methods comprise a step of injecting a second fluid 66 into convergent portion 46 of body 14. In some methods, second fluid 66 may comprise of any of the fluids described above, any hydrocarbon, or any other suitable fluid. In one method, second fluid 66 can comprise a natural gas liquid such as propane, butane, or heavier hydrocarbons, such as, for example, hexane, octane and/or other alkanes, alkenes, alkynes. Second fluid 66 may be injected such that second fluid 66 forms a thin film 70 on a surface of internal channel 18. In one method, film 70 may be formed on the surface of internal channel 18 via momentum transfer from first fluid 42. In some methods, injecting a second fluid 66 may comprise of communicating second fluid 66 to a plurality of injection ports 58 disposed around convergent portion 46, introducing second fluid 66 into the internal channel 18 via opening 62 of the plurality of injection ports 58, and dispersing second fluid 66 into internal channel 18 such that second fluid 66 forms film 70 on a surface of convergent portion 46 of internal channel 18.

Some methods may comprise a step of accelerating first fluid 42 in convergent portion 46 of internal channel 18. First fluid 42 may be accelerated such that first fluid 42 has a higher velocity than second fluid 66. In some methods the velocity of first fluid 42 may be sufficiently high such that We for the system exceeds the critical Weber number ($We_{cr}$). The velocity may be sufficiently high such that Reynolds number of the system exceeds the critical Reynolds number when first fluid 42 enters into divergent portion 86 of internal channel 18.

Accelerating the first fluid 42 can comprise communicating first fluid 42 through convergent portion 46 where the cross-sectional area of internal channel 18 decreases from upstream end 50 to downstream end 54. In some methods, accelerating first fluid 42 may comprise communicating first fluid 42 to shear edge 74 of injection mixer 10. In some methods, accelerating first fluid 42 may cause film 70 of second fluid 66 to break-up into a plurality of droplets due to the momentum transfer of first fluid 42 onto second fluid 66. Fluid break-up may comprise dispersion of film 70 at shear edge 74. Fluid break-up may comprise secondary breakup of stream 78, residual droplets 130, and/or other droplets of second fluid 66. Fluid break-up may cause second fluid 66 to be atomized or dispersed to form new droplets that have a smaller surface area and can easily be dispersed/mixed and/or evaporated in the pipe flow. The steps of injecting second fluid 66 and accelerating first fluid 42 may work separately, or in combination, to achieve consistent droplet size, such that a surface area of each of the plurality of droplets fall into a small range.

Some methods comprise a step of decelerating each of first fluid 42, second fluid 66 and/or fluid mixture 82. In some methods the decelerating occurs in divergent portion 86 of internal channel 18. For example, divergent portion 86 may comprise divergent frustoconical portion 90 such that the cross-sectional area of divergent portion 86 of body 14 increases between upstream end 94 and downstream end 98. Decelerating thus can comprise, for each of the fluids (42, 66) and/or fluid mixture 82, communicating fluid mixture 82 through divergent portion 86 of internal channel 18 such that the fluid decelerates.

Some methods may comprise a step for evaporating the droplets of second fluid 66. In some methods, the evaporation may occur as a result of the temperature of first fluid 42, second fluid 66, fluid mixture 82 and/or any other part of injection mixer 10. The small surface area of the droplet after break-up will help to accelerate evaporation in injection mixer 10. In some methods kinetic energy may, at least in part, contribute to the evaporation of the droplets. Some methods allow for complete and total evaporation of second fluid 66 in injection mixer 10.

Some methods comprise a step of mixing first fluid 42 and second fluid 66. In some methods, mixing may comprise combining first fluid 42 and second fluid 66 into a single pipe flow while both first 42 and second fluids 66 are in a gaseous state. In some methods mixing comprises that no liquid droplets of the second fluid 66 remain in the pipe flow at the end of a specified length downstream from shear edge 74. For example, second fluid 66 may be fully evaporated such that substantially 100% of the second fluid 66 injected into internal channel 18 is in a gaseous state at a point that is 30 feet downstream from shear edge 74.

In some methods, residual droplets 130 may remain in divergent portion 86 of internal channel 18. Residual droplets may occur when less than 100% of the second fluid is dispersed and mixed or evaporated in the pipe flow. Residual droplets 130 can be disposed downstream from shear edge 74. In some methods, the residual droplets 130 may be disposed on concave curved portion 102 of the internal channel 18.

Some methods may comprise a step of inducing turbulent flow in first fluid 42, second fluid 66, or fluid mixture 82. In some embodiments, turbulent flow may occur when first fluid 42 is decelerated in divergent portion 86. Inducing turbulent flow may further comprise of producing backflow re-circulation of first fluid 42 in divergent portion 86 of body 14. The backflow re-circulation may increase velocity of first fluid 42 at a surface of concave curved portion 102. The backflow re-circulation may create a higher velocity of first fluid 42 at a surface of concave curved portion 102 than in the rest of divergent portion 86. In some methods the backflow re-circulation may force any residual droplets 130 on concave curved portion 102 into an interior of internal channel 18. Residual droplets 130 may then be dispersed and mixed in the pipe flow. Residual droplets 130 can be evaporated once they are entrained in the pipe flow. Evaporation may comprise any method of evaporation as previously described.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A multi-fluid injection mixer for injecting a liquid into a gas stream, the multi-fluid injection mixer comprising:
- a body having an interior surface that defines an internal channel, the internal channel comprising:
  - a convergent frustoconical portion extending from an upstream end to a downstream end; and
  - a divergent portion comprising:
    - a divergent frustoconical portion extending from an upstream end to a downstream end; and
    - an annular, concave curved portion connecting the downstream end of the convergent frustoconical portion to the upstream end of the divergent frustoconical portion;
  - where the downstream end of the convergent frustoconical portion defines a first inside diameter of the internal channel and the upstream end of the divergent frustoconical portion defines a second inside diameter of the internal channel; and
  - where the first inside diameter is smaller than the second inside diameter.

2. The multi-fluid injection mixer of claim 1, where:
- the body defines a plurality of injection ports spaced circumferentially in the convergent frustoconical portion; and
- the plurality of injection ports each has a first dimension in a circumferential direction and a second dimension in a longitudinal direction of the internal channel; and
- the first dimension is larger than the second dimension.

3. The multi-fluid injection mixer of claim 2, further comprising an injection assembly coupled to the body, the injection assembly defining one or more conduits in fluid communication with the plurality of injection ports to deliver fluid into the internal channel.

4. The multi-fluid injection mixer of claim 3, where the body comprises:
- an outer pipe defining a channel; and
- an insert comprising the convergent frustoconical portion and the divergent portion, at least a portion of the insert is disposed within the channel of the outer pipe.

5. The multi-fluid injection mixer of claim 1, further comprising a shear edge defined by an acute angle in the body at an intersection of the downstream end of the convergent frustoconical portion and the annular concave curved portion.

6. The multi-fluid injection mixer of claim 5, where the divergent portion has a maximum transverse dimension at the divergent frustoconical portion and is configured to induce turbulent flow in a gas stream.

7. The multi-fluid injection mixer of claim 6, where the shear edge is configured to disperse mixing fluid to form droplets that are subject to secondary breakup and mixing or evaporation as the droplets travel through the divergent frustoconical portion.

8. The multi-fluid injection mixer of claim 7, where the annular, concave curved portion is configured to receive a residual droplet of the mixing fluid that is not entrained by the gas stream at the shear edge.

9. The multi-fluid injection mixer of claim 8, where a curvature of the annular, concave curved portion is configured to induce back flow recirculation in the gas stream facilitate secondary breakup of the residual droplet complete evaporation of the mixing fluid.

10. A method for mixing fluids, the method comprising:
- receiving a first fluid in the multi-fluid injection mixer of claim 1;
- communicating a first fluid through the convergent frustoconical portion;
- injecting a second fluid into the convergent frustoconical portion, accelerating the first fluid, where the first fluid has a higher velocity than the second fluid such that the second fluid is broken up into droplets;
- dispersing the droplets of the second fluid in the divergent portion; and
- mixing the first fluid and the second fluid.

11. The method of claim 10, further comprising:
- inducing backflow re-circulation of the first fluid; and dispersing any residual droplets of the second fluid in the annular, concave curved portion.

12. The method of claim 10, where injecting a second fluid comprises:

communicating the second fluid to a plurality of injection ports disposed around the convergent frustoconical portion;

introducing the second fluid into the internal channel; and dispersing the second fluid in the internal channel such that the second fluid forms a film on a surface of the convergent frustoconical portion.

13. A multi-fluid injection mixer for injecting a liquid into a gas stream, the multi-fluid injection mixer comprising:

a body having an interior surface that defines an internal channel, the body comprising:

a convergent frustoconical portion extending from an upstream end to a downstream end; and a divergent portion comprising:

a divergent frustoconical portion extending from an upstream end to a downstream end; and an annular, concave curved portion disposed between the convergent frustoconical portion and the divergent frustoconical portion;

where the body defines a plurality of injection ports spaced circumferentially in the convergent frustoconical portion, each of the injection ports extending through the interior surface of the body and having, at the interior surface:

a first dimension in a circumferential direction; and a second dimension in a longitudinal direction of the internal channel;

where the first dimension is larger than the second dimension; and where the internal channel defines a flow path from the convergent frustoconical portion, into the annular, concave curved portion, and to the divergent frustoconical portion.

14. The multi-fluid injection mixer of claim 13, where the body comprises:

an outer pipe defining a channel; and an insert comprising the convergent frustoconical portion and the divergent portion, at least a portion of the insert is disposed within the channel of the outer pipe.

15. The multi-fluid injection mixer of claim 14, where:

the annular, concave curved portion defines a first inside diameter of the internal channel that is less than a second inside diameter defined by the upstream end of the divergent frustoconical portion; and the first inside diameter of the internal channel is greater than a third inside diameter defined by the downstream end of the convergent frustoconical portion.

16. The multi-fluid injection mixer of claim 13, further comprising a shear edge defined by an acute angle in the body at an intersection of the downstream end of the convergent frustoconical portion and the annular concave curved portion.

17. The multi-fluid injection mixer of claim 16, where a longitudinal distance between the plurality of injection ports and the shear edge is less than 5 mm.

18. The multi-fluid injection mixer of claim 16, where a curvature of the annular, concave curved portion is configured to induce back flow recirculation in the gas stream to re-entrain a residual fraction of the mixing fluid that is not entrained by the gas stream at the shear edge.

19. The multi-fluid injection mixer of claim 13, where the first dimension is 2-15 mm.

20. The multi-fluid injection mixer of claim 13, further comprising:

a first pipe segment coupled to an upstream end of the body;

a second pipe segment coupled to a downstream end of the body; and an injection assembly in fluid communication with the plurality of injection ports.

* * * * *